United States Patent [19]

Sheth

[11] 4,072,452

[45] Feb. 7, 1978

[54] ROTARY COMPRESSOR VANE WITH BUILT-IN SPRING

[75] Inventor: Rajesh N. Sheth, Mt. Prospect, Ill.

[73] Assignee: Borg-Warner Corporation, Chicago, Ill.

[21] Appl. No.: 709,065

[22] Filed: July 27, 1976

[51] Int. Cl.[2] ..... F04C 29/00; F16F 1/46

[52] U.S. Cl. ..... 418/266; 267/153

[58] Field of Search ..... 418/121, 122, 123, 266, 418/267; 267/153

[56] References Cited

U.S. PATENT DOCUMENTS

| | | | |
|---|---|---|---|
| 3,152,552 | 10/1964 | Frenzel | 418/122 X |
| 3,180,564 | 4/1965 | Fuhrmann et al. | 418/122 X |
| 3,191,503 | 6/1965 | Fuehrer | 418/266 |
| 3,277,833 | 10/1966 | Hudgens | 418/122 X |

FOREIGN PATENT DOCUMENTS

| | | | |
|---|---|---|---|
| 1,401,992 | 11/1968 | Germany | 418/122 |

*Primary Examiner*—William L. Freeh
*Assistant Examiner*—Leonard Smith
*Attorney, Agent, or Firm*—Richard J. Schlott

[57] ABSTRACT

A rotary sliding vane compressor having means for biasing the vanes outwardly. Such means include an elastomeric element fastened to the radially inward edge of the vane and means for applying tensile stress to stretch the elastomeric element responsive to a radially inward movement of the vane. The restoring force provided by stretching the elastomeric element in tension ensures that the vanes will be moved outwardly during the expansion phase of rotor travel.

3 Claims, 6 Drawing Figures fig.1.
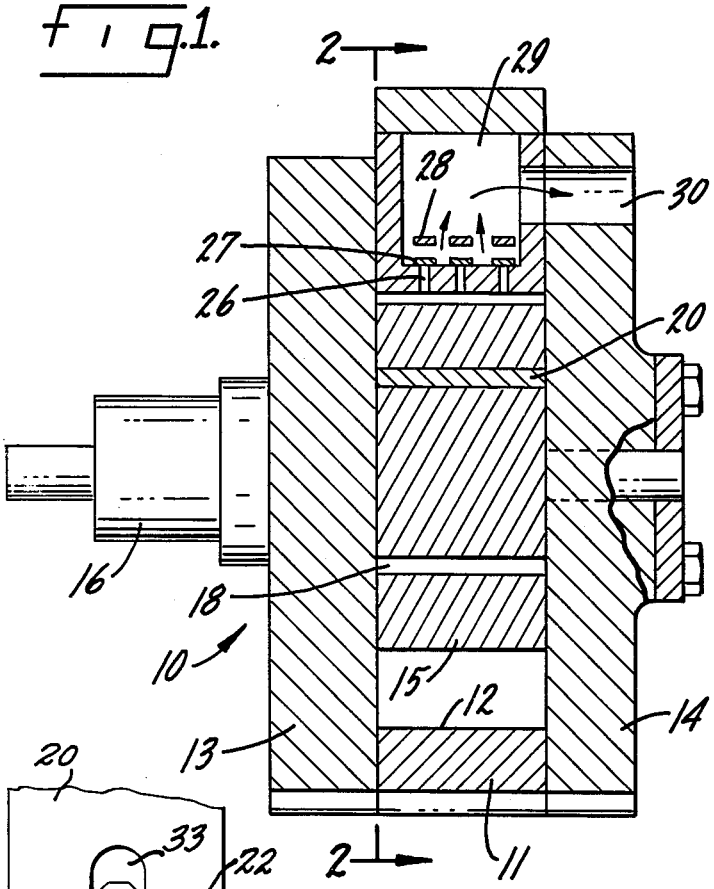
fig.3.
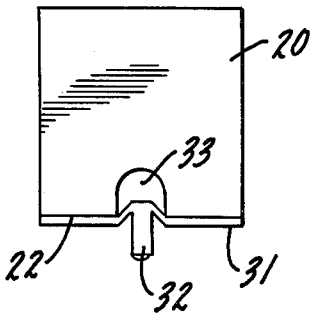
fig.4.
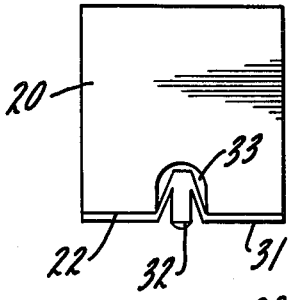
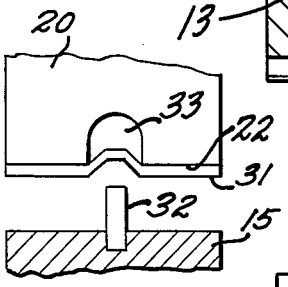
fig.6.
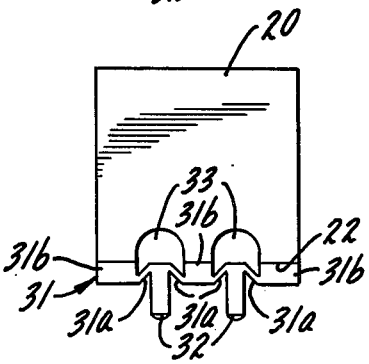
fig.5.
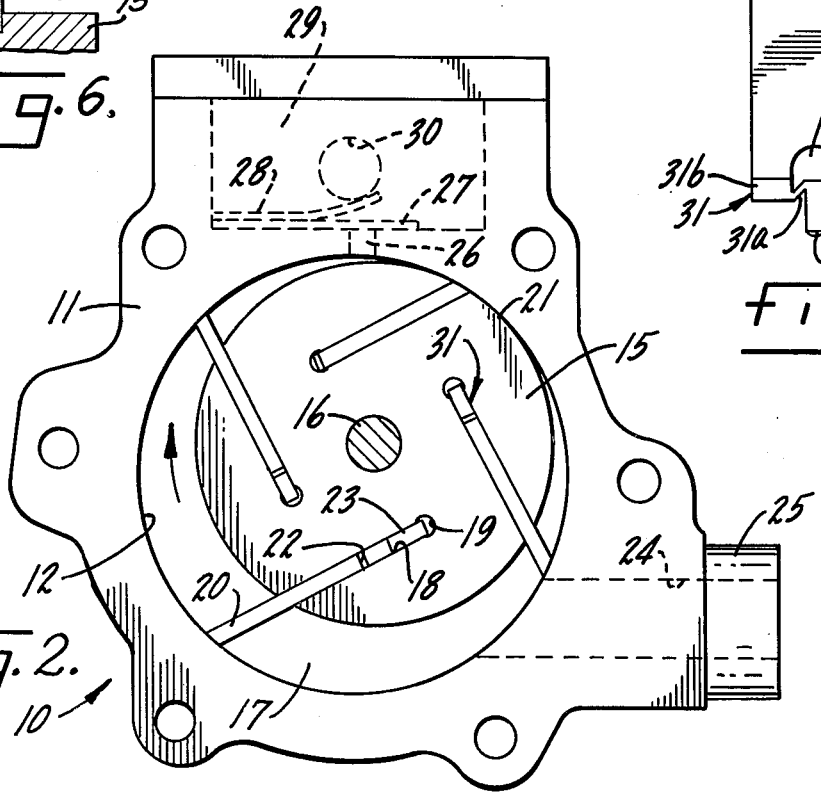
fig.2.

ROTARY COMPRESSOR VANE WITH BUILT-IN SPRING

BACKGROUND OF THE INVENTION

1. Field of the Invention

A rotary sliding vane compressor having means for urging the vanes outwardly and maintaining the vane tips in engagement with the cylinder wall during start-up and low rotational speeds.

2. Description of the Prior Art

Burnett U.S. Pat. No. 3,376,825 describes a rotary vane compressor having a leaf type spring element between the radially inner portion of the vane and the bottom of the vane slot. The spring is designed so that during high speed operation, when centrifugal forces are sufficient to maintain the vane tips in contact with the cylinder wall, the same centrifugal forces will cause the spring to collapse against radially inner edges of the vane and thus become ineffective as a spring element.

Kenney, et al, U.S. Pat. No. 2,045,014, describes a rotary sliding vane compressor having a leaf type spring in the bottom of the vane slot with its ends embedded in the bottom of the vane.

Calabretta, Ser. No. 639,030, filed Dec. 9, 1975, now U.S. Pat. No. 4,012,183 Guzy and Sheth, Ser. No. 691,061, filed May 28, 1976, now U.S. Pat. No. 4,032,270 and Sheth, Ser. No. 691,060, filed May 28, 1976, now U.S. Pat. No. 4,032,269 disclose various composite spring means, each having a metal leaf spring element and a bonded rubber or elastomeric damper element, located in the bottom of the vane slot and engaging a convexly shaped edge on the vane. Each of these composite spring elements operate by flexing the elastomeric and metal leaf components to provide the biasing force.

SUMMARY OF THE INVENTION

This invention relates in general to rotary sliding vane compressors and more particularly to an effective means for biasing the vanes radially outwardly to maintain the vane tips in sliding engagement with the cylindrical wall of the rotor chamber which forms the gas working space. Although rotor sliding vane compressors are known in a great many forms, the description herein is directed to a conventional type in which a rotor is provided with a plurality of extensible vanes each received with a generally radially oriented or canted vane slot in the rotor. The rotor is received within a cylindrical chamber or stator and mounted such that its axis is offset with respect to the cylindrical stator axis, thus providing a generally crescent shaped gas working space. The rotor is in sliding contact with a portion of the cylindrical wall, and this contact point divides the low pressure side from the high pressure side. An inlet port communicates with one side of the gas working space and a discharge port communicates with the opposite side. Gas is trapped between adjacent vanes and carried around through the the compression zone. The volume of each pocket or compartment, as defined between adjacent vanes and the rotor and stator surfaces, becomes smaller as it approaches the discharge port thus compressing the gas trapped therein.

A problem is often encountered in operating compressors of the type described above in that the vanes sometimes will not maintain their tips in engagement with the cyclindrical stator wall under all conditions. This is especially true at start-up when the rotor is travelling at low rotational velocities. The centrifugal force which would normally tend to throw the vanes outwardly is not sufficient to overcome the vacuum created when the vanes begin to move from their most radially inward portion to the point directly opposite the contact point. The latter may be regarded as a dash-pot effect and is extremely powerful in resisting the outward thrust of the vanes.

Several techniques have been used in the prior art to hold the vane tips in engagement with the cylindrical wall. Basically, these may be divided into two catagories: mechanical (such as spring) and hydraulic or pneumatic. The mechanical springs used may take many forms, such as the leaf springs described in Burnett, Kenney et al. and English, or helical (coil) springs. Just as common are the hydraulic or pneumatic means such as described in Gibson et al.

In the present invention, a mechanical element is employed which overcomes many of the disadvantages of the springs heretofore known. It is difficult to obtain any significant service life when using a leaf or coil spring in the typical rotary compressor environment. With each revolution of the rotor the spring is compressed and released. Since the compressors operate at several hundred R.P.M., it is apparent that the springs undergo flexing at unusually high rates and thus are subject to flexural fatigue and failure.

The present invention employs a novel vane having an elastomeric spring element fastened at the radially inner edge which is adapted to be placed in tension and stretched in response to a radially inward movement of the vane. The restoring force provided by stretching the elastomeric spring element will bias the vane outwardly to maintain the vane tips in sliding engagement with the cylinder walls. Unlike prior art spring elements, no metal leaf is employed in the instant invention, and the elastomeric spring element is subjected only to tensile stretching. Both compressive and flexural stressing of the spring element is avoided, and lengthened service life is ensured.

The assembly is compact, inexpensive to install, and requires no special modifications to conventional compressor parts.

Advantages to this system include the fact that since no hydraulic means are provided for maintaining the vanes extended, it is not necessary to provide either a lubricant pump or other means for collecting and distributing oil and/or refrigerant to the undervane spaces. It also provides instant pumping action upon start-up, reduces hammering and consequent vane wear caused by delayed movement of the vane to the extended position, eliminates reverse rotation at rotor shutdown often caused by equalization of pressures between the high and low sides of the compressor rotor, and results in lower discharge gas temperature.

BRIEF DESCRIPTION OF THE DRAWINGS

FIG. 1 is a cross sectional view of a rotary sliding vane compressor constructed in accordance with the principles of the present invention;

FIG. 2 is a cross sectional view taken along the plane of line 2—2 of FIG. 1;

FIG. 3 is a side view of the vane;

FIG. 4 is a view similar to FIG. 3 showing the elastomeric spring element in its fully flexed position.

FIG. 5 is a side view of a vane showing an alternate embodiment of the invention.

FIG. 6 is a fragmentary side view of a vane showing a modification of the vane in FIG. 3.

DESCRIPTION OF THE PREFERRED EMBODIMENTS

Referring now to the drawings, particularly to FIGS. 1 and 2, there is shown a typical rotary compressor of generally conventional design including a stator housing 10 comprising a cylinder block 11 having a circular bore extending therethrough to provide a cylinder wall 12 a front end plate 13, and a rear end plate 14. Within housing 10 there is provided a rotor 15 connected to and driven by drive shaft 16. The rotor is eccentrically mounted within the cylinder so that it is in close running contact with the cylinder wall 12 at a contact point 21 and forms a crescent-shaped gas working space or compression cavity 17. The rotor is provided with a plurality of vane slots 18 each having a bottom surface 19 and receiving vanes 20 which are adapted to reciprocate within each vane slot with their upper edges 25 in continuous engagement with cylinder wall 12. It may be seen that the lower sides of each slot, the bottom edge 22 of the vanes 20, and the bottom of the vane slot 19 define what will be referred to as the "undervane space", designated 23.

Suction gas is admitted to the compression cavity 17 through connection 24 and passage 25. Gas is discharged through a series of openings 26 (adjacent the contact point) which are covered by reed-type discharge valves 27, limited by valve stops 28. Discharge gas flows into chamber 29 and then into passage 30 in rear plate 14.

In FIG. 3 there is shown a vane 20. Fastened to the lower edge 22 of vane 20 is an elastomeric spring element 31, in the form of a thin flat elastomeric band. Positioned below the elastomeric element are means for applying tensile stress in the form of a plunger 32, and lower edge 22 of vane 20 includes a recessed area 33 to receive the plunger and the elastomeric spring element. Plunger 32 may be formed integrally with the elastomeric band 31 or separately formed and fastened thereto. Alternatively the plunger may be fastened to and made a part of the bottom of the vane slot as shown in FIG. 6 as a modification of the vane of FIG. 3.

Before the vane is fully depressed, as shown in FIG. 3, the elastomeric spring element 31 contacts the vane bottom through the plunger 32. The elastomeric spring element is extended into the vane's recessed area 33, but is under little or no tension.

As best shown in FIG. 4, after the vane is depressed downwardly in the vane slot, the elastomeric spring element 31 is in a condition where plunger 32 displaced a portion of the elastomeric spring element 31 into the recessed area 33, thus placing the elastomeric element under a tensile stress and stretching a portion of the elastomeric spring element. At this point the elastomeric spring element is in a condition to bias the vane outwardly against the cylinder wall and this will result in immediate pumping action upon start-up prior to generation of enough centrifugal force to hold the vanes in contact with the cylinder wall.

While a variety of elastomeric compounds may be used in making element 31, they should be resistant to the oil-refrigerant environment in which they must operate in a refrigeration/air conditioning application. Suitable materials would include urethane, nitrile, epichlorohydrin, fluorocarbon and silicone rubbers.

In FIG. 5 there is shown an alternate preferred embodiment of the present invention in the form of a vane 20 having bonded there to an elastomeric spring element 31. Spaced below the elastomeric spring element are means for applying tensile stress in the form of two plungers 32 and the lower edge 22 of vane 20 is recessed in two areas 33 to accommodate each of the plungers and the elastomeric spring elements. It will be seen in this embodiment the elastomeric spring element 31 includes thin portions 31*a*, and thicker portions 31*b* in the areas in contact with and bonded to lower vane edge 22. The thick portions 31*b* effect a reduction in the sheer stresses in the bond areas by limiting the elongation and stretching of the elastomeric spring element to the thin portions 31*a*. The use of two plungers 32 as means for applying tensile stress to stretch the elastomeric spring element distributes the load more evenly and effects a greater bias force for a given radially inward displacement of the vane.

In the embodiment shown in FIG. 5, the elastomeric element 31 and plungers 32 are integrally formed by a single molding operation. The element is bonded to the vane 20 at lower edge 22 by a suitable adhesive such as Ty Ply BN, available from Hughson Chemical Corporation. Alternative methods for bonding include the use of staking and pinning methods, and it will be apparent that the elastomeric spring element could be formed to the vane by an insert molding operation.

While this invention has been described in connection with certain specific embodiments thereof, it is to be understood that this is by way of illustration and not by way of limitation; and the scope of the appended claims should be construed as broadly as the prior art will permit.

I claim:

1. A rotary compressor of the type including a cylindrical rotor having a plurality of extensible vanes received in complementary vane slots, a vane, an elastomeric spring means fastened to the radially inner edge of said vane, and means for applying tensile stress to stretch said elastomeric spring means responsive to a radially inward movement of said vane.

2. The apparatus of claim 1 wherein the means for applying tensile stress comprises at least one plunger fastened to said elastomeric spring means.

3. The apparatus of claim 1 wherein the means for applying tensile stress comprises at least one plunger fastened at the bottom of said vane slots.

* * * * *